US011767954B1

(12) United States Patent
Chen

(10) Patent No.: US 11,767,954 B1
(45) Date of Patent: Sep. 26, 2023

(54) CEILING FAN UPPER LIGHT

(71) Applicant: AIR COOL INDUSTRIAL CO., LTD., Taichung (TW)

(72) Inventor: Ken-Tuan Chen, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 18/049,830

(22) Filed: Oct. 26, 2022

(51) Int. Cl.

| | |
|---|---|
| ***F21S 8/04*** | (2006.01) |
| ***F21V 33/00*** | (2006.01) |
| *F21Y 113/10* | (2016.01) |
| *F21Y 115/10* | (2016.01) |

(52) U.S. Cl.
CPC ..... *F21S 8/04* (2013.01); *F21V 33/0096* (2013.01); *F21Y 2113/10* (2016.08); *F21Y 2115/10* (2016.08)

(58) Field of Classification Search
CPC ..... F21S 8/04; F21V 33/0096
See application file for complete search history.

(56) References Cited

U.S. PATENT DOCUMENTS

| | | | | |
|---|---|---|---|---|
| 11,215,188 | B2 * | 1/2022 | Kohen | F04D 29/582 |
| 11,236,753 | B1 * | 2/2022 | Campbell | F04D 29/005 |
| 11,320,135 | B1 * | 5/2022 | Wang | F21V 33/0096 |
| 11,400,177 | B2 * | 8/2022 | Wald | F04D 25/088 |
| 2022/0381429 | A1 * | 12/2022 | Wang | G03B 21/001 |
| 2023/0047172 | A1 * | 2/2023 | McKinzie | F04D 25/088 |

* cited by examiner

*Primary Examiner* — Christopher E Dunay
(74) *Attorney, Agent, or Firm* — Sinorica International Patent & Trademark

(57) ABSTRACT

A ceiling fan upper light includes a light casing. The light casing has at least one side wall made of a light-pervious material. At least one shielding plate made of an opaque material is annularly disposed inside the light casing. At least one groove is annularly disposed inside the light casing. The at least one groove is located between the at least one side wall and the at least one shielding plate. A plurality of light-emitting diodes is annularly disposed inside the light casing. The light-emitting diodes are located in the at least one groove. The light-emitting diodes do not extend out of the at least one groove. The light-emitting diodes emit light toward the opening of the groove, so as to prevent the light from directly irradiating the outside of the at least one side wall, so that the at least one side wall displays the light color of the light-emitting diodes.

10 Claims, 4 Drawing Sheets

CEILING FAN UPPER LIGHT

FIELD OF THE INVENTION

The present invention relates to a ceiling fan, and more particularly to a ceiling fan upper light.

BACKGROUND OF THE INVENTION

In general, a conventional ceiling fan is provided with a lamp under the ceiling fan. The lamp includes a light bulb and a lampshade. The bulb emits light downward and laterally. The light from the bulb is directed towards the lampshade and passes through the lampshade. When the user looks under the ceiling fan towards the ceiling fan, the light may dazzle the user and the user will feel uncomfortable. The casing of the ceiling fan is arranged above the blades. The color of the casing of the ceiling fan is changeless. At night, it is impossible to clearly see and appreciate the casing of the ceiling fan.

Accordingly, the inventor of the present invention has devoted himself based on his many years of practical experiences to solve these problems.

SUMMARY OF THE INVENTION

The primary object of the present invention is to provide a ceiling fan upper light, which can display the light color of the light-emitting diodes on the outer wall of the light, change the light color of the light-emitting diodes and reduce glare of light, thereby increasing the convenience and visual effect of use.

In order to achieve the above object, the present invention provides a ceiling fan upper light. The ceiling fan upper light is coupled to a ceiling fan. The ceiling fan has a ceiling fan body and at least one blade. The ceiling fan upper light comprises a light casing, at least one shielding plate, at least one shielding plate, at least one groove, and an LED light-emitting module. The light casing has two seats and at least one side wall. A first space is defined between the seats and the at least one side wall. The at least one side wall surrounds the first space. The seats are fixed to a top and a bottom of the at least one side wall, respectively. The seats are made of an opaque material. The at least one side wall is made of a light-pervious material. The light casing is fixedly connected to the ceiling fan body. The shielding plate is fixedly connected to at least one of the seats. The at least one shielding plate is annularly disposed in the light casing. The at least one shielding plate is located in the first space. A second space is defined between the at least one shielding plate and the seats. The at least one shielding plate is made of an opaque material. The at least one shielding plate shields the second space. The at least one groove is annularly disposed inside the light casing. The at least one groove is adjacent to an inner side of the at least one side wall. An opening is formed on one side of the groove adjacent to the at least one side wall. The at least one groove is recessed from the side adjacent to the at least one side wall toward another side away from the at least one side wall along an extending direction of the at least one side wall. The at least one groove is located outside the at least one shielding plate. The LED light-emitting module includes a plurality of light-emitting diodes. The light-emitting diodes are annularly disposed in the light casing. The light-emitting diodes are located in the at least one groove. The light-emitting diodes emit light toward the opening of the corresponding groove. The light-emitting diodes do not extend out of the at least one groove.

When the ceiling fan is connected to a power source, the ceiling fan supplies power to the LED light-emitting module so that the light-emitting diodes emit light toward the opening of the groove, and the groove restricts a light irradiation direction to prevent the light from directly irradiating an outside of the at least one side wall so that the at least one side wall displays light colors of the light-emitting diodes.

DETAILED DESCRIPTION OF THE PREFERRED EMBODIMENTS

Embodiments of the present invention will now be described, by way of example only, with reference to the accompanying drawings.

Figure 1:
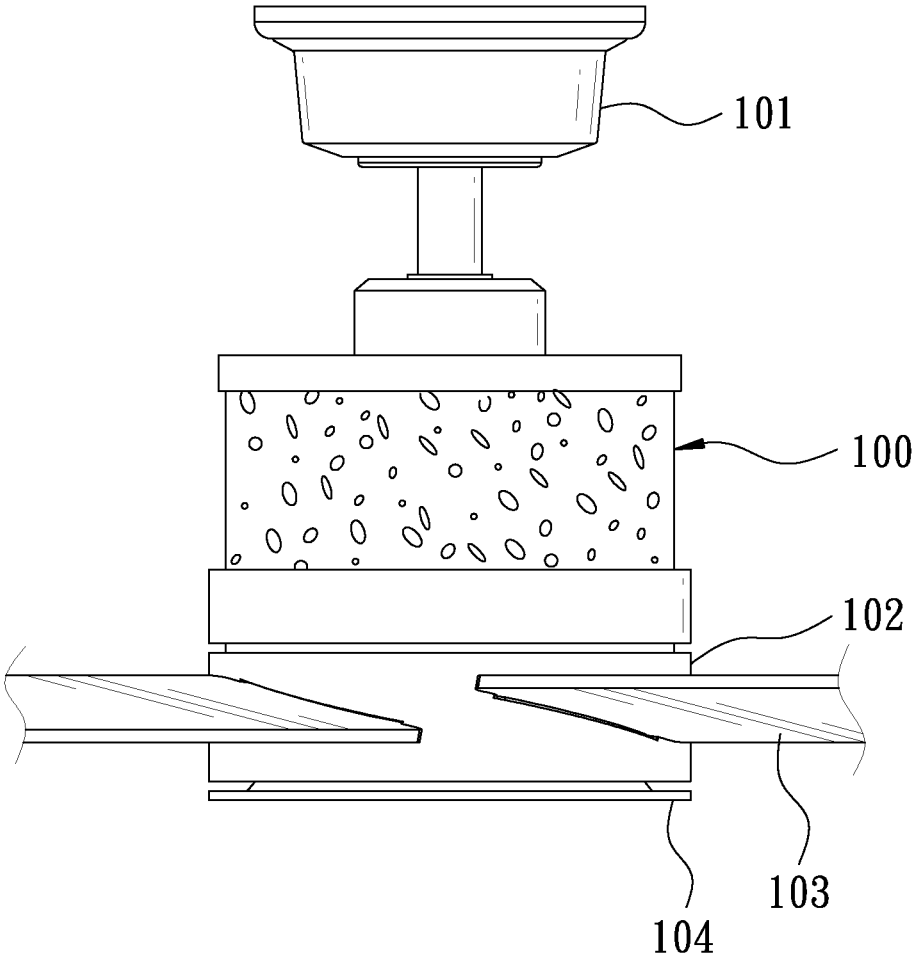
FIG. 1 is a partial side view in accordance with an embodiment of the present invention.
Figure 2:
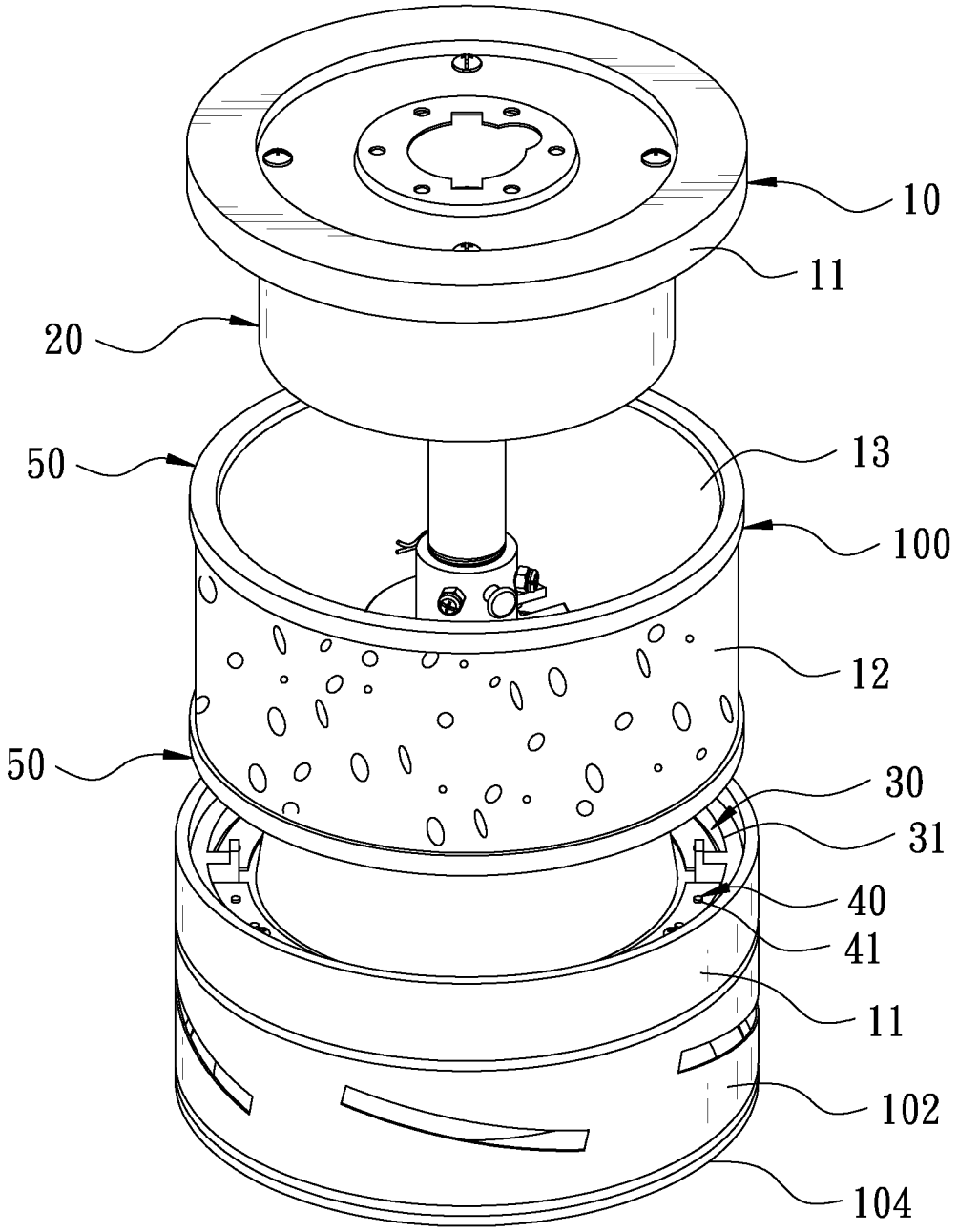
FIG. 2 is a partial exploded view in accordance with the embodiment of the present invention.
Figure 3:
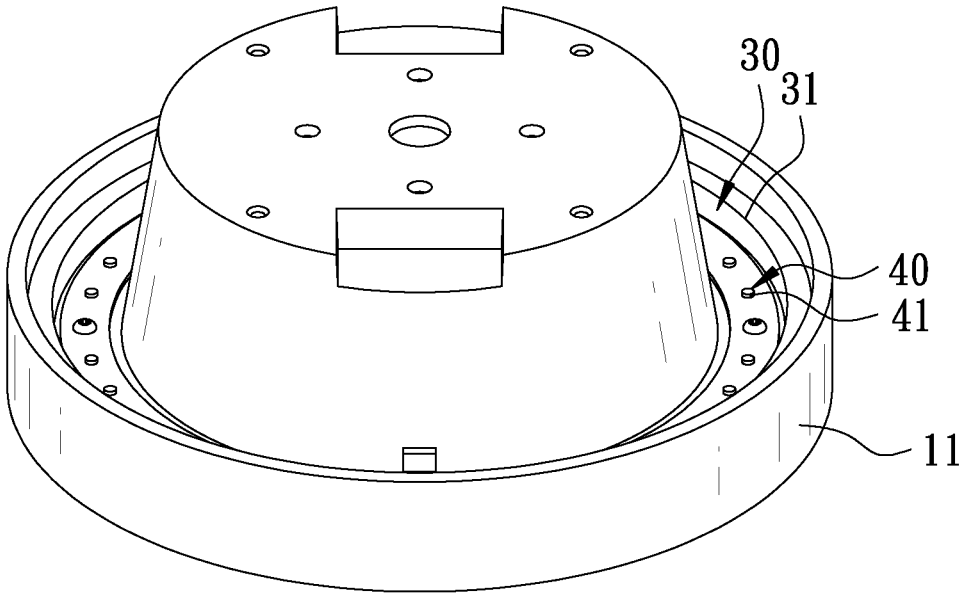
FIG. 3 is a perspective view in accordance with the embodiment of the present invention, showing the seat corresponding to the groove.
Figure 4:
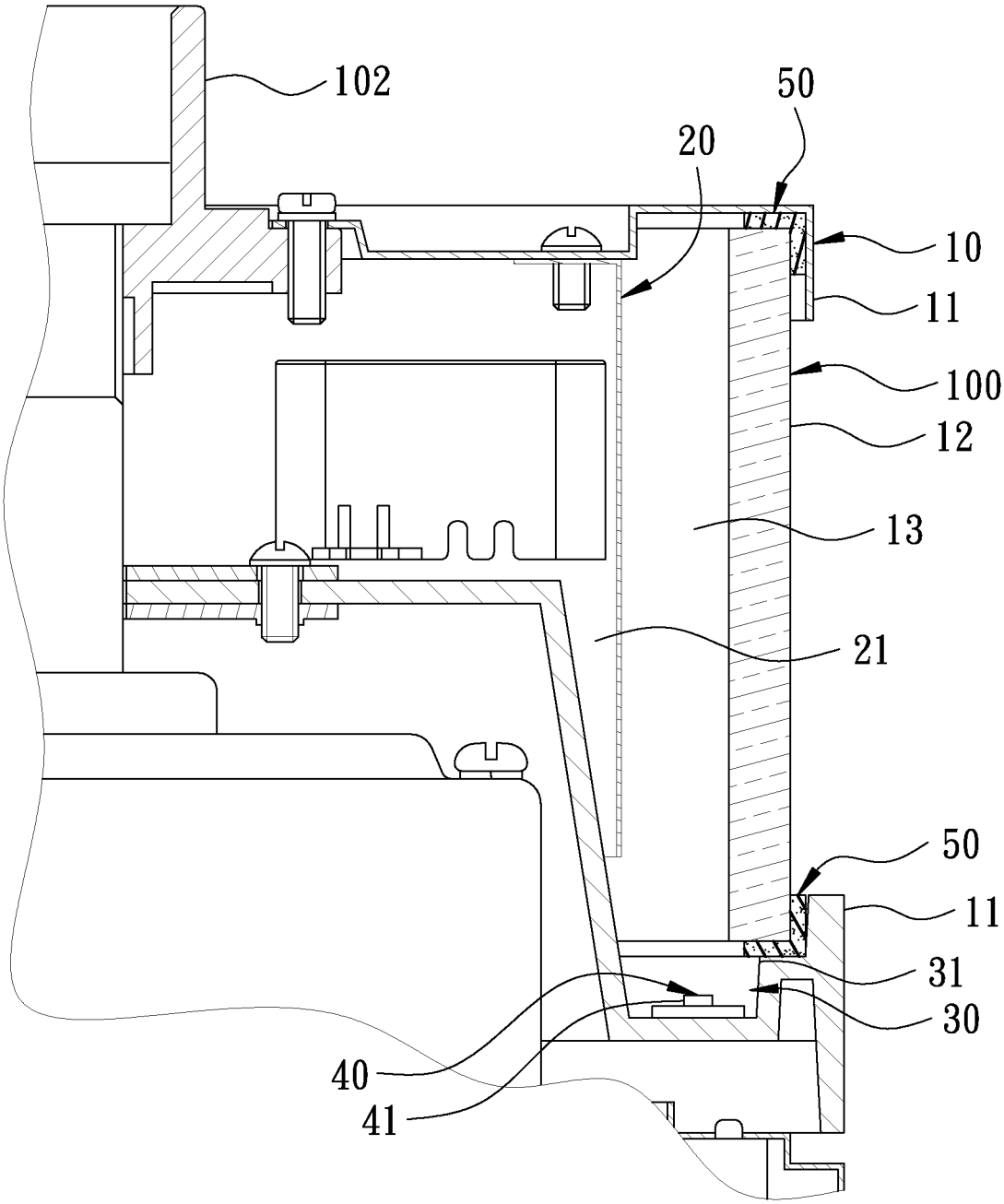
FIG. 4 is a cross-sectional view in accordance with the embodiment of the present invention, showing the interior of the light casing.

Referring to FIG. 1 through FIG. 4, the present invention discloses a ceiling fan upper light 100. The ceiling fan upper light 100 is coupled to a ceiling fan 101. The ceiling fan 101 has a ceiling fan body 102 and at least one blade 103. The ceiling fan body 102 is composed of at least one of a down rod, an adapter, a fixing member, a motor, a casing and a ceiling fan accessory. A lamp 104 is provided below the ceiling fan body 102. The ceiling fan upper light 100 includes a light casing 10, at least one shielding plate 20, at least one groove 30, an LED light-emitting module 40, and two coupling rings 50.

The light casing 10 has two seats 11 and at least one side wall 12. The light casing 10 is disposed above the at least one blade 103. The seats 11 are fixedly connected to the ceiling fan body 102. A first space 13 is defined between the seats 11 and the at least one side wall 12. The at least one side wall 12 surrounds the first space 13. The at least one side wall 12 extends longitudinally. The seats 11 are fixed to the top and the bottom of the at least one side wall 12, respectively. The seats 11 are made of an opaque material. The at least one side wall 12 is made of a light-pervious material. The light casing 10 is fixedly connected to the ceiling fan body 102. In the embodiment of the present invention, the at least one side wall 12 is made of seedy glass.

The shielding plate 20 is fixedly connected to at least one of the seats 11. The at least one shielding plate 20 is annularly disposed in the light casing 10. The at least one shielding plate 20 is located in the first space 13. A second space 21 is defined between the at least one shielding plate 20 and the seats 11. The ceiling fan body 102 passes through the second space 21. The at least one shielding plate 20 is made of an opaque material and non-reflective material. The at least one shielding plate 20 shields the second space 21. The at least one shielding plate 20 shields the ceiling fan body 102 passing through the second space 21.

The at least one groove 30 is annularly disposed inside the light casing 10. One of the seats 11 has the at least one groove 30. The at least one groove 30 is adjacent to the inner side of the at least one side wall 12. An opening 31 is formed on one side of the groove 30 adjacent to the at least one side wall 12. The opening 31 of the at least one groove is adjacent to the at least one side wall 12. The at least one groove 30 is recessed from the side adjacent to the at least one side wall 12 toward another side away from the at least one side wall 12 along the extending direction of the at least one side wall 12. The at least one groove 30 is longitudinally recessed from the corresponding seat 11 in a direction away from the at least one side wall 12. The at least one groove 30 is located outside the at least one shielding plate 20.

The LED light-emitting module 40 includes a plurality of light-emitting diodes 41. The light-emitting diodes 41 are annularly disposed in the light casing 10. The light-emitting diodes 41 are located in the at least one groove 30. The light-emitting diodes 41 emit light toward the opening 31 of the corresponding groove 30. The light-emitting diodes 41 do not extend out of the at least one groove 30. The LED light-emitting module can change the color of light, so that the at least one side wall 12 has the function of changing colors.

The coupling rings 50 are disposed inside the respective seats 11, and the coupling rings 50 are located on the top and the bottom of the at least one side wall 12, respectively. The seats 11 are fastened to the top and the bottom of the at least one side wall 12 through the coupling rings 50, respectively.

Therefore, when the ceiling fan 101 is connected to a power source, the ceiling fan 101 supplies power to the LED light-emitting module 40, so that the light-emitting diodes 41 emit light toward the opening 31 of the groove 30. The groove 30 restricts the direction of light irradiation to prevent the light from directly irradiating the outside of the at least one side wall 12, so that the at least one side wall 12 displays the light colors of the light-emitting diodes 41. The light simultaneously presents a bright effect on the at least one side wall 12 made of seedy glass. With the function of changing the light color of the LED light-emitting module 40, the user can change the color of the side wall 12 of the light casing 10 to change various visual effects. The second space 21 is shielded by the at least one shielding plate 20, so that the visual effect of the side wall 12 of the light casing 10 is more obvious and exquisite.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ceiling fan upper light, coupled to a ceiling fan configured to attach to a ceiling surface, the ceiling fan having a ceiling fan body and at least one blade, wherein the ceiling fan upper light is disposed between the ceiling surface and the at least one blade, the ceiling fan upper light comprising:

a light casing, having two seats and at least one side wall, a first space being defined between the seats and the at least one side wall, the at least one side wall surrounding the first space, the seats being fixed to a top and a bottom of the at least one side wall respectively, the seats being made of an opaque material, the at least one side wall being made of a light-pervious material, the light casing being fixedly connected to the ceiling fan body;

at least one shielding plate, fixedly connected to at least one of the seats, the at least one shielding plate being annularly disposed in the light casing, the at least one shielding plate being located in the first space, a second space being defined between the at least one shielding plate and the seats, the at least one shielding plate being made of an opaque material, the at least one shielding plate shielding the second space;

at least one groove, annularly disposed inside the light casing, the at least one groove being adjacent to an inner side of the at least one side wall, an opening being formed on one side of the groove adjacent to the at least one side wall, the at least one groove being recessed from the side adjacent to the at least one side wall toward another side away from the at least one side wall along an extending direction of the at least one side wall, the at least one groove being located outside the at least one shielding plate;

an LED light-emitting module, including a plurality of light-emitting diodes, the light-emitting diodes being annularly disposed in the light casing, the light-emitting diodes being located in the at least one groove, the light-emitting diodes emitting light toward the opening of the corresponding groove, the light-emitting diodes not extending out of the at least one groove;

wherein when the ceiling fan is connected to a power source, the ceiling fan supplies power to the LED light-emitting module so that the light-emitting diodes emit light toward the opening of the groove, and the groove restricts a light irradiation direction to prevent the light from directly irradiating an outside of the at least one side wall so that the at least one side wall displays light colors of the light-emitting diodes.

2. The ceiling fan upper light as claimed in claim 1, wherein the opening of the at least one groove is adjacent to the at least one side wall.

3. The ceiling fan upper light as claimed in claim 1, wherein one of the seats has the at least one groove.

4. The ceiling fan upper light as claimed in claim 3, wherein the at least one side wall extends longitudinally, and the at least one groove is longitudinally recessed from the corresponding seat in a direction away from the at least one side wall.

5. The ceiling fan upper light as claimed in claim 4, further comprising two coupling rings disposed inside the respective seats, the coupling rings being located on the top and the bottom of the at least one side wall respectively, the seats being fastened to the top and the bottom of the at least one side wall through the coupling rings, respectively.

6. The ceiling fan upper light as claimed in claim 5, wherein the seats are fixedly connected to the ceiling fan body.

7. The ceiling fan upper light as claimed in claim 6, wherein the ceiling fan body passes through the second space.

8. The ceiling fan upper light as claimed in claim 1, wherein the light casing is disposed above the at least one blade.

9. The ceiling fan upper light as claimed in claim 8, wherein the at least one shielding plate is made of a non-reflective material, and the at least one side wall is made of seedy glass.

10. The ceiling fan upper light as claimed in claim 9, wherein the LED light-emitting module is capable of changing light-emitting colors, and a lamp is provided below the ceiling fan body.

* * * * *